US007750240B2

(12) United States Patent
Jiang et al.

(10) Patent No.: US 7,750,240 B2
(45) Date of Patent: Jul. 6, 2010

(54) COAXIAL CABLE

(75) Inventors: Kai-Li Jiang, Beijing (CN); Liang Liu, Beijing (CN); Kai Liu, Beijing (CN); Qing-Yu Zhao, Beijing (CN); Yong-Chao Zhai, Beijing (CN); Shou-Shan Fan, Beijing (CN)

(73) Assignees: Beijing FUNATE Innovation Technology Co., Ltd., Beijing (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/321,572

(22) Filed: Jan. 22, 2009

(65) Prior Publication Data

US 2009/0194313 A1 Aug. 6, 2009

(30) Foreign Application Priority Data

Feb. 1, 2008 (CN) ..... 2008 1 0066046

(51) Int. Cl.
*H01B 7/18* (2006.01)

(52) U.S. Cl. ..... 174/102 R; 174/103; 174/106 R

(58) Field of Classification Search ..... 174/28, 174/102 R, 106 R, 108, 102 SC, 106 SC, 174/103
See application file for complete search history.

(56) References Cited

U.S. PATENT DOCUMENTS 4,132,828 A 1/1979 Nakamura et al.
7,045,716 B2 * 5/2006 Granheim ..... 174/102 SC
7,413,474 B2 * 8/2008 Liu et al. ..... 439/579
7,449,631 B2 * 11/2008 Lee et al. ..... 174/28
7,459,627 B2 * 12/2008 Lee et al. ..... 174/28
7,491,883 B2 * 2/2009 Lee et al. ..... 174/28
2004/0020681 A1 * 2/2004 Hjortstam et al. ..... 174/102 SC
2004/0053780 A1 3/2004 Jiang et al.
2005/0170177 A1 * 8/2005 Crawford et al. ..... 428/375
2007/0151744 A1 7/2007 Chen
2008/0170982 A1 7/2008 Zhang et al.

FOREIGN PATENT DOCUMENTS

CN 1483667 3/2004
CN 1992099 7/2007

OTHER PUBLICATIONS

Y .Zhang et al.Metal coating on suspended carbon nanotubes and its implication to metal-tube interaction,Chemical Physics Letters,Nov. 24, 2000,35-41,331,Elsevier Science.

* cited by examiner

*Primary Examiner*—William H Mayo, III
(74) *Attorney, Agent, or Firm*—D. Austin Bonderer

(57) ABSTRACT

A coaxial cable includes a core, an insulating layer, a shielding layer, a sheathing layer. The core includes an amount of carbon nanotubes having at least one conductive coating disposed about the carbon nanotubes. The carbon nanotubes are orderly arranged. The insulating layer is about the core. The shielding layer is about the insulating layer. The sheathing layer is about the shielding layer.

23 Claims, 11 Drawing Sheets

COAXIAL CABLE

RELATED APPLICATIONS

This application claims all benefits accruing under 35 U.S.C. §119 from China Patent Application No. 200810066046.8, filed on 2008 Feb. 1 in the China Intellectual Property Office, the disclosure of which is incorporated herein by reference. This application is related to commonly-assigned, applications entitled, "METHOD FOR MAKING COAXIAL CABLE", Ser. No. 12/321,573, filed Jan. 22, 2009; "INDIVIDUALLY COATED CARBON NANOTUBE WIRE-LIKE STRUCTURE", Ser. No. 12/321,568, filed Jan. 22, 2009; "METHOD FOR MAKING INDIVIDUALLY COATED AND TWISTED CARBON NANOTUBE WIRE-LIKE STRUCTURE", Ser. No. 12/321,551, filed Jan. 22, 2009, (Atty. Docket No. US19083): "CARBON NANOTUBE COMPOSITE FILM", Ser. No. 12/321,557, filed Jan. 22, 2009; "METHOD FOR MAKING CARBON NANOTUBE COMPOSITE STRUCTURE", Ser. No. 12/321,570, filed Jan. 22, 2009; "COAXIAL CABLE", 12/321,569, filed Jan. 22, 2009. The disclosures of the above-identified applications are incorporated herein by reference.

BACKGROUND

1. Technical Field

The present disclosure relates to coaxial cables and, particularly, to a carbon nanotube based coaxial cable.

2. Discussion of Related Art

Coaxial cables are used as carriers to transfer electrical power and signals. A conventional coaxial cable includes a core, an insulating layer outside the core, and a shielding layer outside the insulating layer, usually surrounded by a sheathing layer. The core includes at least one conducting wire. The conducting wire can be a solid or braided wire, and the shielding layer can, for example, be a wound foil, a woven tape, or a braid. However, as for the conducting wire made of a metal, a skin effect will occur in the conducting wire, thus the effective resistance of the cable becomes larger, and causes signal decay during transmission. Further, the conducting wire and the shielding layer made of metal has less strength for its size, so must be comparatively greater in weight and diameter, and thus in use.

A related art method for making coaxial cable includes the following steps of: coating a polymer on an outer surface of the at least one conducting wire to form an insulating layer; applying a plurality of metal wire or braided metal wire on the insulating layer to form a shielding layer; and covering a sheathing layer on the shielding layer.

Carbon nanotubes (CNTs) are a novel carbonaceous material and received a great deal of interest since the early 1990s. Carbon nanotubes have interesting and potentially useful heat conducting, electrical conducting, and mechanical properties. A conducting wire made by a mixture of carbon nanotubes and metal has been developed. However, the carbon nanotubes in the conducting wire of the prior art are arranged disorderly. Thus, the above-mentioned skin effect has still not been eliminated in coaxial cables employing carbon nanotubes.

What is needed, therefore, is a coaxial cable having good conductivity, high mechanical performance, lightweight and with small diameter to overcome the aforementioned shortcomings.

BRIEF DESCRIPTION OF THE DRAWINGS

Many aspects of the present coaxial cable and method for making the same can be better understood with references to the accompanying drawings. The components in the drawings are not necessarily drawn to scale, the emphasis instead being placed upon clearly illustrating the principles of the present coaxial cable and method for making the same.

Figure 1:
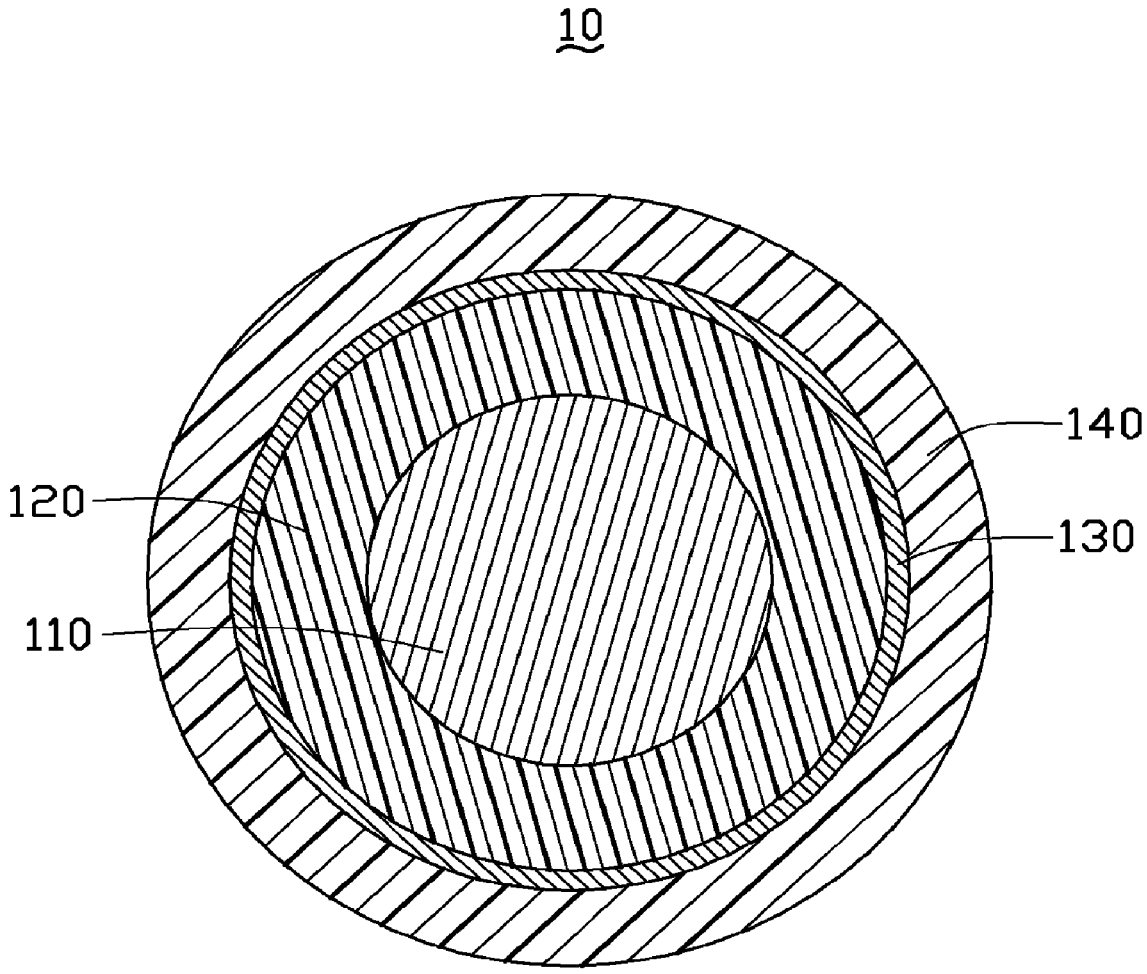
FIG. 1 is a schematic section view of a coaxial cable, in accordance with a first embodiment.

Corresponding reference characters indicate corresponding parts throughout the several views. The exemplifications set out herein illustrate at least one embodiment of the present coaxial cable and method for making the same, in at least one form, and such exemplifications are not to be construed as limiting the scope of the invention in any manner.

DETAILED DESCRIPTION OF EXEMPLARY EMBODIMENTS

References will now be made to the drawings to describe, in detail, embodiments of the present coaxial cable and method for making the same.

Referring to FIG. 1, a coaxial cable 10 according to a first embodiment includes a core 110, an insulating layer 120 wrapping the outer circumferential surface of the core 110, a shielding layer 130 surrounding the outer circumferential surface of the insulating layer 120, and a sheathing layer 140 covering the outer circumferential surface of the shielding layer 130. The core 110, the insulating layer 120, the shielding layer 130, and the sheathing layer 140 are coaxial.

The core 110 has at least one carbon nanotube wire-like structure. Specifically, the core 110 includes a single carbon nanotube wire-like structure or a plurality of carbon nanotube wire-like structures. In the present embodiment, the core 110 includes one carbon nanotube wire-like structure. A diameter of the carbon nanotube wire-like structure can range from about 4.5 nanometers to about 1 millimeter or even larger (e.g., about 20 millimeters to 30 millimeters). In the present embodiment, the diameter of the carbon nanotube wire-like structure ranges from about 1 micrometers to about 30 micrometers. It is to be understood that when the core 110 has a plurality of the carbon nanotube wire-like structure, the diameter of the core 110 can be set as desired.

The carbon nanotube wire-like structure includes a plurality of carbon nanotubes 111 (shown in FIG. 2) and at least one conductive coating covered on the outer surfaces of the carbon nanotubes. The one conductive coating comprises of at lease one conductive layer 114. The carbon nanotubes are joined end-to-end by and combined by van der Waals attractive force between them. Further, the carbon nanotube wire-like structure can include a twisted carbon nanotube wire with a plurality of carbon nanotubes aligned around the axis of the carbon nanotube twisted wire like a helix. The carbon nanotube wire-like structure can also include an non-twisted carbon nanotube wire, and the carbon nanotubes of the non-twisted carbon nanotube wire are arranged along an axis of the carbon nanotube wire-like structure (e.g., the carbon nanotubes are relatively straight and the axis of the carbon nanotubes are parallel to the axis of the non-twisted carbon nanotube wire). A diameter of the carbon nanotube wire-like structure can range from about 4.5 nanometers to about 1 millimeter or even larger. In the present embodiment, the diameter of the carbon nanotube wire-like structure ranges from about 10 nanometers to about 30 micrometers.

Figure 2:
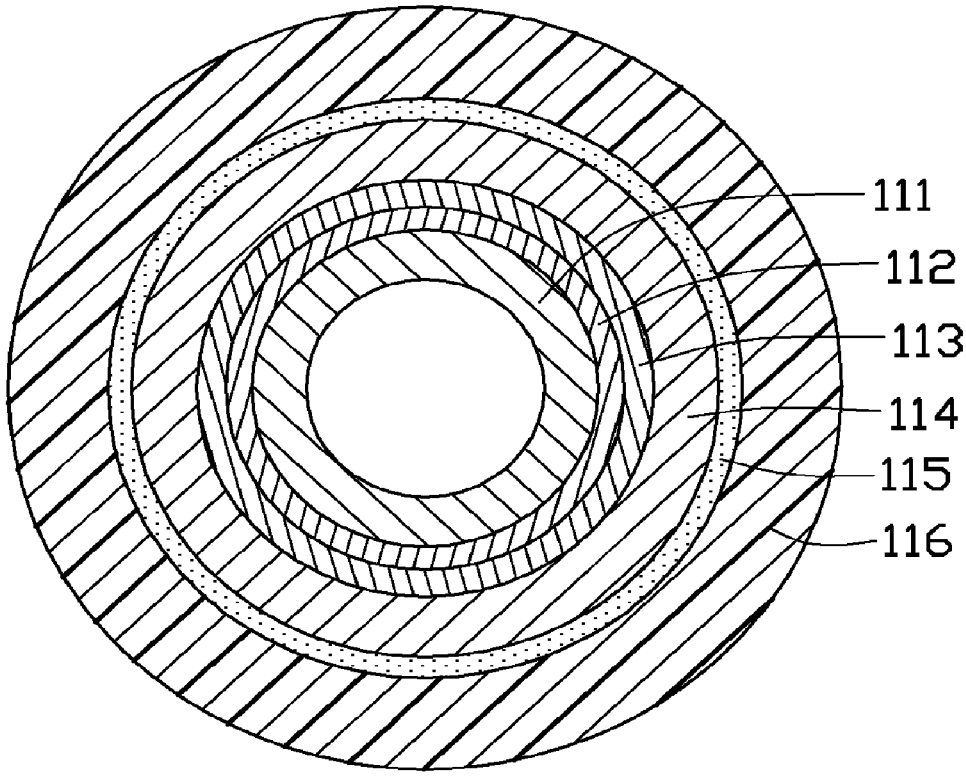
FIG. 2 is a schematic section view of an individual carbon nanotube coated with conductive coating, in accordance with the first embodiment.

Referring to FIG. 2, each of the carbon nanotubes 111 in the carbon nanotube wire-like structure (not shown) is covered by the at least one conductive coating on the outer surface thereof. A conductive coating is in direct contact with the outer surface of the individual carbon nanotube 111. More specifically, the at least one layer of conductive coating further may include a wetting layer 112, a transition layer 113 and an anti-oxidation layer 115. As mentioned above, the conductive coating has at least one conductive layer 114. In the present embodiment, the at least one conductive coating includes a wetting layer 112, that is applied to the outer circumferential surface of the carbon nanotube 111, a transition layer 113 covering the outer circumferential surface of the wetting layer 112, at least one conductive layer 114 wrapping the outer circumferential surface of the transition layer 113, and an anti-oxidation layer 115 covering the outer circumferential surface of the conductive layer 114.

Wettability between carbon nanotubes and most kinds of metal is poor. Therefore, if used, the wetting layer 112 is configured to provide a good transition between the carbon nanotube 111 and the conductive layer 114. The material of the wetting layer 112 can be selected from the group consisting of iron (Fe), cobalt (Co), nickel (Ni), palladium (Pd), titanium (Ti), and any combination alloy thereof. A thickness of the wetting layer 112 ranges from about 1 nanometer to about 10 nanometers. In the present embodiment, the material of the wetting layer 112 is Ni and the thickness of the wetting layer 112 is about 2 nanometers. The use of the wetting layer 112 is optional.

The transition layer 113 is arranged for combining the wetting layer 112 with the conductive layer 114. The material of the transition layer 113 should be one that works well both with the material of the wetting layer 112 and the material of the conductive layer 114. Materials such as copper (Cu), silver (Ag), or alloys thereof can be used. A thickness of the transition layer 113 ranges from about 1 nanometer to about 10 nanometers. In the present embodiment, the material of the transition layer 113 is Cu and the thickness is about 2 nanometers. The use of the transition layer 113 is optional.

The conductive layer 114 is arranged for enhancing the conductivity of the carbon nanotube twisted wire. The material of the conductive layer 114 can be selected from any suitable conductive material including Cu, Ag, gold (Au) and combination alloys thereof. A thickness of the conductive layer 114 ranges from about 1 nanometer to about 20 nanometers. In the first embodiment, the material of the conductive layer 114 is Ag and has a thickness of about 10 nanometers.

The anti-oxidation layer 115 is configured to prevent the conductive layer 114 from being oxidized by exposure to the air and prevent reduction of the conductivity of the core 110. The material of the anti-oxidation layer 115 can be any suitable material including gold (Au), platinum (Pt), and any other anti-oxidation metallic materials or combination alloys thereof. A thickness of the anti-oxidation layer 115 ranges from about 1 nanometer to about 10 nanometers. In the present embodiment, the material of the anti-oxidation layer 115 is Pt and the thickness is about 2 nanometers. The use of the anti-oxidation layer 115 is optional.

Furthermore, a strengthening layer 116 can be applied the outer surface of the conductive coating to enhance the strength of the coated carbon nanotubes. The material of the strengthening layer 116 can be any suitable material including a polymer with high strength, such as polyvinyl acetate (PVA), polyvinyl chloride (PVC), polyethylene (PE), or paraphenylene benzobisoxazole (PBO). A thickness of the strengthening layer 116 approximately ranges from 0.1 to 1 micron. In the present embodiment, the strengthening layer 116 covers the anti-oxidation layer 115, the material of the strengthening layer 116 is PVA, and the thickness of the strengthening layer 116 is about 0.5 microns. The use of the strengthening layer 116 is optional.

The insulating layer 120 is used to insulate the core 110. A material of the insulating layer 120 can be any suitable insulated material such as polytetrafluoroethylene, polyethylene, polypropylene, polystyrene, polyethylene foam and nanoclay-polymer composite material. In the present embodiment, the material of the insulating layer 120 is polyethylene foam.

The shielding layer 130 is made of electrically conductive material. The shielding layer 130 is used to shield electromagnetic signals or external signals. Specifically, the shielding layer 130 can be formed by woven wires or by winding films around the insulating layer 120. The wires can be metal wires, carbon nanotube wires or composite wires having carbon nanotubes. The films can be metal films, carbon nanotube films or a composite film having carbon nanotubes. The carbon nanotubes in the carbon nanotube film are arranged in an orderly manner or in a disorderly manner.

A material of the metal wires or metal films can be any suitable material including copper, gold or silver, and other metals or their alloys having good electrical conductivity. The carbon nanotube wires and carbon nanotube films include a plurality of carbon nanotubes oriented along a preferred direction, joined end to end, and combined by van der Waals attractive force. The composite film can be composed of metals and carbon nanotubes, polymer and carbon nanotubes, or polymer and metals. The material of the polymer can be polyethylene terephthalate (PET), polycarbonate (PC), acrylonitrile-Butadiene Styrene Terpolymer (ABS), polycarbonate/acrylonitrile-butadiene-styrene (PC/ABS) polymer materials, or other suitable polymer. When the shielding layer 130 is a composite film having carbon nanotubes, the shielding layer 130 can be formed by dispersing carbon nanotubes in a solution of the composite to form a mixture, and coating the mixture on the insulating layer 120. Specifically, the shielding layer 130 includes two or more layers formed by the wires or films or combination thereof.

The sheathing layer 140 is made of insulating material. In the first embodiment, the sheathing layer 140 can be made of nano-clay-polymer composite materials. The nano-clay can be nano-kaolin clay or nano-montmorillonite. The polymer can be silicon resin, polyamide, polyolefin, such as polyethylene or polypropylene. In the present embodiment, the sheathing layer 140 is made of nano-clay-polymer composite materials. The nano-clay-polymer composite material has good mechanical property, fire-resistant property, and can provide protection against damage from machinery, chemical exposure, etc.

Figure 3:
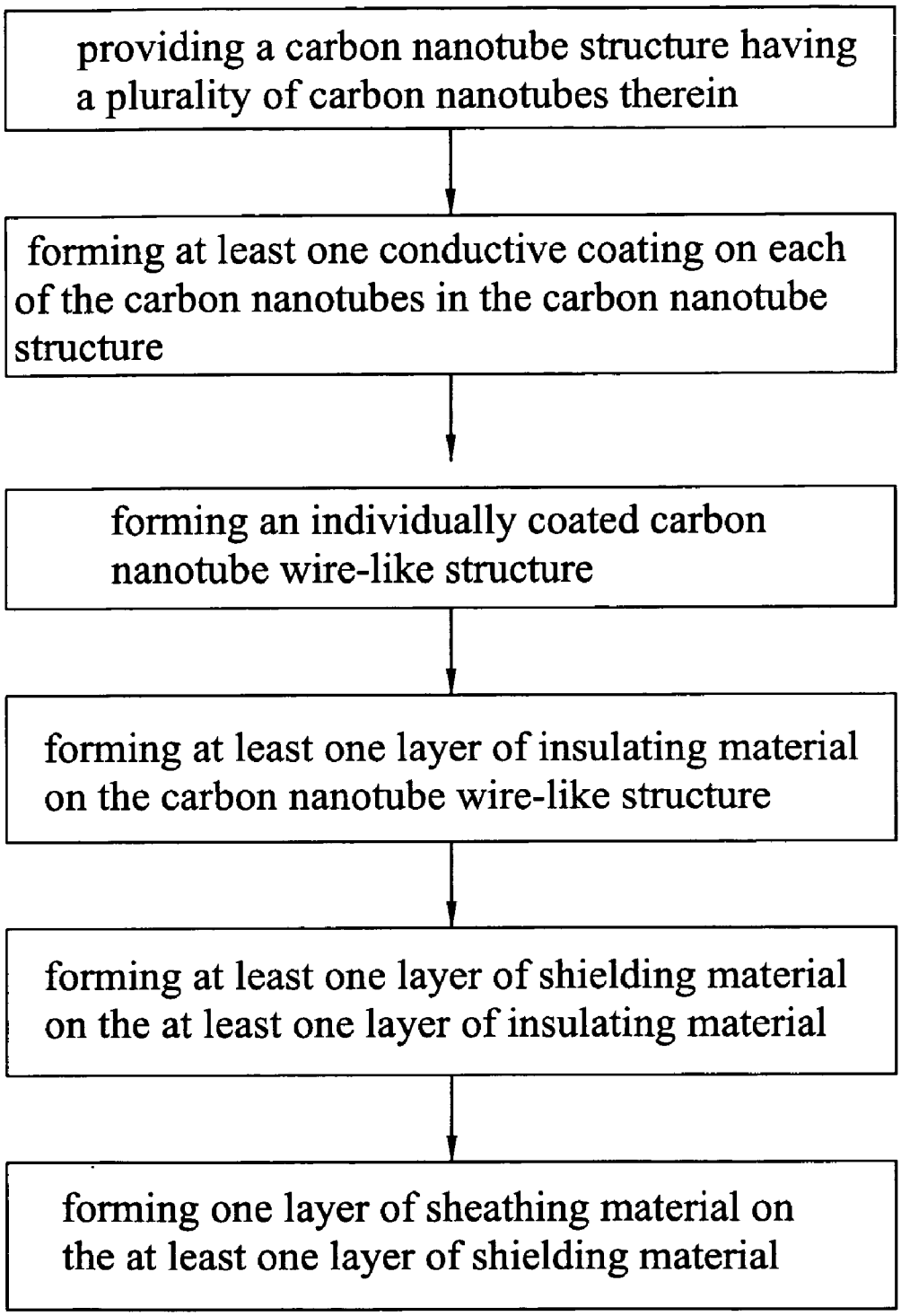
FIG. 3 is a flow chart of a method for making the coaxial cable of FIG. 1.
Figure 4:
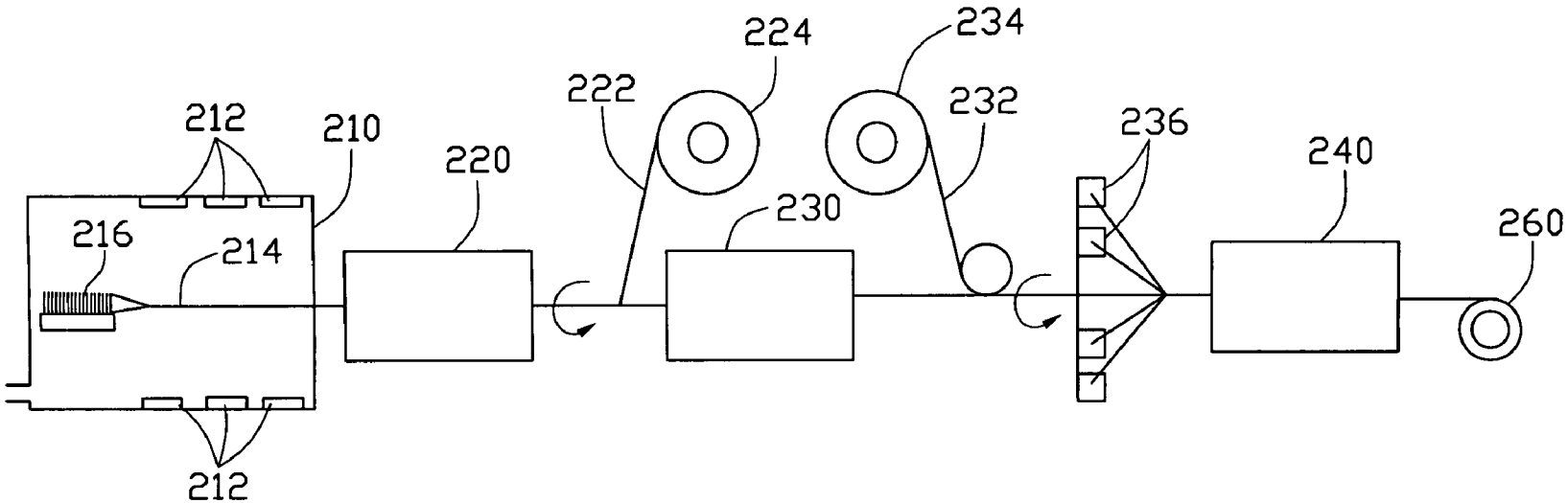
FIG. 4 is a system for making the coaxial cable as the method of FIG. 3.

Referring to FIG. 3 and FIG. 4, a method for making the coaxial cable 10 includes the following steps: (a) providing a carbon nanotube structure 214 having a plurality of carbon nanotubes therein; (b) forming at least one conductive coating on each of the carbon nanotubes in the carbon nanotube structure 214; (c) forming an individually coated carbon nanotube wire-like structure 222; (d) forming at least one layer of insulating material on the carbon nanotube wire-like structure 222; (e) forming at least one layer of shielding material on the at least one layer of insulating material; and (f) forming one layer of sheathing material on the at least one layer of shielding material.

In step (a), the carbon nanotube structure 214 can be a carbon nanotube film. The carbon nanotube film can be fabricated by the following substeps of: (a1) providing a carbon nanotube array 216 (e.g., a super-aligned carbon nanotube array 216); (a2) pulling out a carbon nanotube film from the carbon nanotube array 216 by using a tool (e.g., adhesive tape, pliers, tweezers, or another tool allowing multiple carbon nanotubes to be gripped and pulled simultaneously).

In step (a1), a super-aligned carbon nanotube array 216 can be formed by a chemical vapor deposition method and in detail includes the following substeps: (a11) providing a substantially flat and smooth substrate; (a12) forming a catalyst layer on the substrate; (a13) annealing the substrate with the catalyst layer in air at a temperature approximately ranging from 700° C. to 900° C. for about 30 to 90 minutes; (a14) heating the substrate with the catalyst layer to a temperature approximately ranging from 500° C. to 740° C. in a furnace with a protective gas therein; and (a15) supplying a carbon source gas to the furnace for about 5 to 30 minutes to grow the super-aligned carbon nanotube array 216 on the substrate.

In step (a11), the substrate can be a P-type silicon wafer, an N-type silicon wafer, or a silicon wafer with a film of silicon dioxide thereon. In the present embodiment, a 4-inch P-type silicon wafer is used as the substrate.

In step (a12), the catalyst can be made of iron (Fe), cobalt (Co), nickel (Ni), or any alloy thereof.

In step (a14), the protective gas can be made up of at least one of nitrogen ($N_2$), ammonia ($NH_3$), and a noble gas. In step (a15), the carbon source gas can be a hydrocarbon gas, such as ethylene ($C_2H_4$), methane ($CH_4$), acetylene ($C_2H_2$), ethane ($C_2H_6$), or any combination thereof.

The super-aligned carbon nanotube array 216 can be approximately 200 to 400 microns in height and includes a plurality of carbon nanotubes parallel to each other and approximately perpendicular to the substrate. The carbon nanotubes in the carbon nanotube array 216 can be single-walled carbon nanotubes, double-walled carbon nanotubes, or multi-walled carbon nanotubes. Diameters of the single-walled carbon nanotubes approximately range from 0.5 nanometers to 10 nanometers. Diameters of the double-walled carbon nanotubes approximately range from 1 nanometer to 50 nanometers. Diameters of the multi-walled carbon nanotubes approximately range from 1.5 nanometers to 50 nanometers.

The super-aligned carbon nanotube array 216 formed under the above conditions is essentially free of impurities such as carbonaceous or residual catalyst particles. The carbon nanotubes in the super-aligned carbon nanotube array 216 are closely packed together by van der Waals attractive force.

In step (a2), the carbon nanotube film can be formed by the following substeps: (a21) selecting a plurality of carbon nanotube segments having a predetermined width from a carbon nanotube array 216; and (a22) pulling the carbon nanotube segments at an even/uniform speed to achieve the carbon nanotube film.

In step (a21), the carbon nanotube segments having a predetermined width can be selected by using an adhesive tape such as the tool to contact the carbon nanotube array 216. Each carbon nanotube segment includes a plurality of carbon nanotubes parallel to each other. In step (a22), the pulling direction is arbitrary (e.g., substantially perpendicular to the growing direction of the carbon nanotube array 216).

Figure 5:
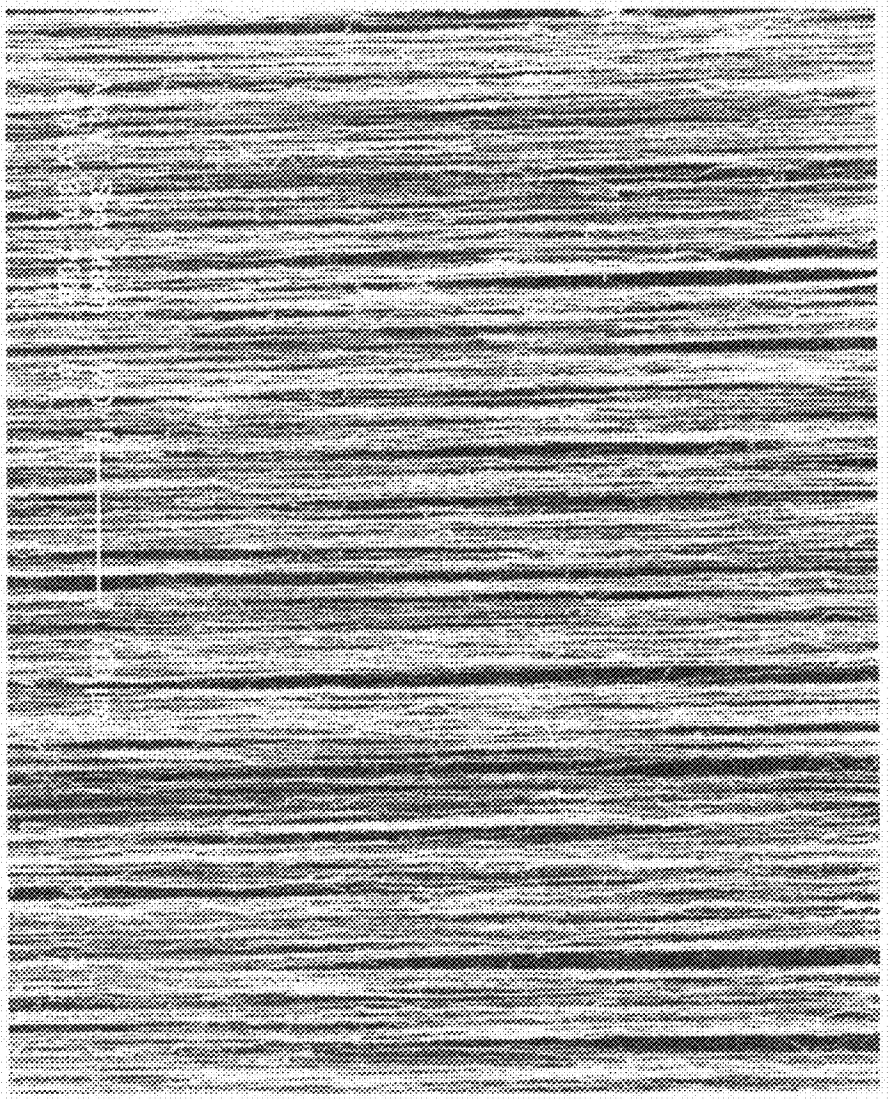
FIG. 5 shows a Scanning Electron Microscope (SEM) image of a carbon nanotube film used in the method for making the coaxial cable of FIG. 1.

More specifically, during the pulling process, as the initial carbon nanotube segments are drawn out, other carbon nanotube segments are also drawn out end-to-end due to the van der Waals attractive force between ends of adjacent segments. This process of drawing ensures that a continuous, uniform carbon nanotube film having a predetermined width can be formed. Referring to FIG. 5, the carbon nanotube film includes a plurality of carbon nanotubes joined end-to-end. The carbon nanotubes in the carbon nanotube film are all substantially parallel to the pulling/drawing direction of the carbon nanotube film, and the carbon nanotube film produced in such manner can be selectively formed to have a predetermined width. The carbon nanotube film formed by the pulling/drawing method has superior uniformity of thickness and superior uniformity of conductivity over a typically disordered carbon nanotube film. Furthermore, the pulling/drawing method is simple, fast, and suitable for industrial applications.

The length and width of the carbon nanotube film depends on a size of the carbon nanotube array 216. When the substrate is a 4-inch P-type silicon wafer, as in the first embodiment, the width of the carbon nanotube film approximately ranges from 0.01 centimeters to 10 centimeters, the thickness of the carbon nanotube film approximately ranges from 0.5 nanometers to 100 microns, and the length of the the carbon nanotube film can reach to and above 100 meters.

In step (b), the at least one conductive coating can be formed on carbon nanotubes in the carbon nanotube structure 214 by a physical vapor deposition (PVD) method such as a vacuum evaporation or a sputtering. In the first embodiment, the at least one conductive coating is formed by a vacuum evaporation method.

The vacuum evaporation method for forming the at least one conductive coating of step (b) can further include the following substeps: (b1) providing a vacuum container 210 including at least one vaporizing source 212; and (b2) heating the at least one vaporizing source 212 to deposit the conductive coating on two opposite surfaces of the carbon nanotube structure 214.

In step (b1), the vacuum container 210 includes a depositing zone therein. In the present embodiment, three pairs of vaporizing sources 212 are respectively mounted on top and bottom portions of the depositing zone. Each pair of vaporizing sources 212 includes an upper vaporizing source 212 located on a top surface of the depositing zone, and a lower vaporizing source 212 located on a bottom surface of the depositing zone. The two vaporizing sources 212 are are on opposite sides of the vacuum container 210. Each pair of vaporizing sources 212 is made of a type of metallic material. To vary the materials in different pairs of vaporizing sources 212, the wetting layer 112, the transition layer 113, the conductive layer 114, and the anti-oxidation layer 115 can be orderly formed on the carbon nanotubes in the carbon nanotube structure 214. The vaporizing sources 212 can be arranged along a pulling direction of the carbon nanotube structure 214 on the top and bottom portions of the depositing zone. The carbon nanotube structure 214 is located in the vacuum container 210 and between the upper vaporizing source 212 and the lower vaporizing source 212. There is a distance between the carbon nanotube structure 214 and the vaporizing sources 212. An upper surface of the carbon nanotube structure 214 directly faces the upper vaporizing sources 212. A lower surface of the carbon nanotube structure 214 directly faces the lower vaporizing sources 212. The vacuum container 210 can be vacuum-exhausted by using of a vacuum pump (not shown).

Figure 6:
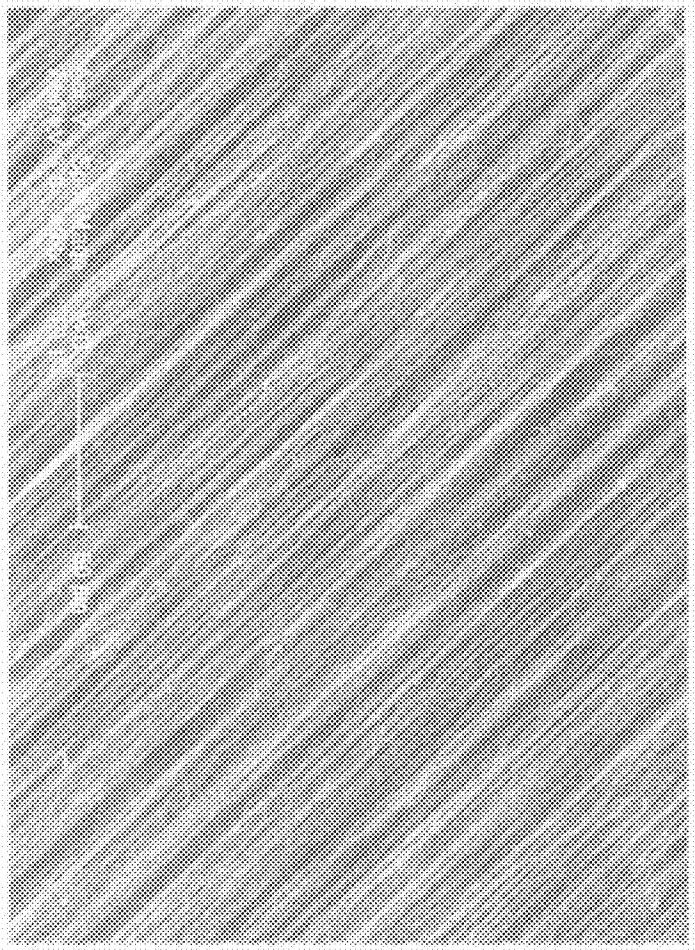
FIG. 6 shows a Scanning Electron Microscope (SEM) image of the carbon nanotube film with at least one layer of conductive coating individually coated on each carbon nanotube therein used in the method for making the coaxial cable of FIG. 1.
Figure 7:
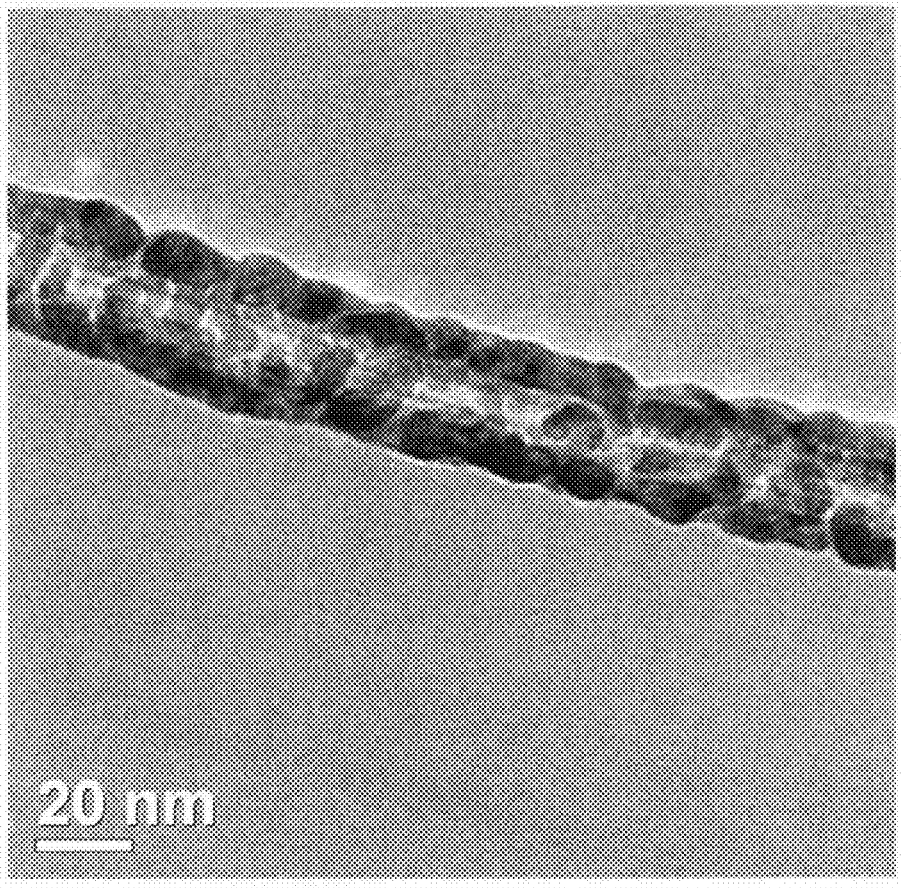
FIG. 7 shows a Transmission Electron Microscope (TEM) image of a carbon nanotube in the carbon nanotube film with at least one layer of conductive coating individually coated thereon of the carbon nanotube of FIG. 6.

In step (b2), the vaporizing source 212 can be heated by a heating device (not shown). The material in the vaporizing source 212 is vaporized or sublimed to form a gas. The gas meets the cold carbon nanotubes in the carbon nanotube structure 214 and coagulates on the upper surface and the lower surface of carbon nanotubes in the carbon nanotube structure 214. Due to a plurality of interspaces existing between the carbon nanotubes in the carbon nanotube structure 214, in addition to the carbon nanotube structure 214 being relatively thin, the conductive material can be infiltrated in the interspaces between the carbon nanotubes in the carbon nanotube structure 214. As such, the conductive material can be deposited on the outer surface of most, if not all, of the carbon nanotubes. A microstructure of the carbon nanotube structure 214 with at least one conductive coating is shown in FIG. 6 and FIG. 7.

Each vaporizing source 212 can have a corresponding depositing area by adjusting the distance between the carbon nanotube film and the vaporizing sources 212. The vaporizing sources 212 can be heated simultaneously, while the carbon nanotube structure 214 is pulled through the multiple depositing zones between the vaporizing sources 212 to form multiple layers of conductive material.

To increase density of the gas in the depositing zone, and prevent oxidation of the conductive material, the vacuum degree in the vacuum container 210 can be above 1 Pascal (Pa). In the first embodiment, the vacuum degree is about $4\times10^{-4}$ Pa.

It is to be understood that the carbon nanotube array 216 formed in step (a1) can be directly placed in the vacuum container 210. The carbon nanotube structure 214 such as carbon nanotube film can be pulled in the vacuum container 210 and successively pass each vaporizing source 212, with each conductive coating continuously depositing. Thus, the pulling step and the depositing step can be performed simultaneously.

In the first embodiment, the method for forming the at least one conductive coating includes the following steps: forming a wetting layer 112 on a surface of the carbon nanotube structure 214; forming a transition layer 113 on the wetting layer 112; forming a conductive layer 114 on the transition layer 113; and forming an anti-oxidation layer 115 on the conductive layer 114. In the above-described method, the steps of forming the wetting layer 112, the transition layer 113, and the anti-oxidation layer 115 are optional.

It is to be understood that the method for forming at least one conductive coating on each of the carbon nanotubes in the carbon nanotube structure 214 in step (b) can be a physical method such as vacuum evaporating or sputtering as described above, and can also be a chemical method such as electroplating or electroless plating. In the chemical method, the carbon nanotube structure 214 can be disposed in a chemical solution.

The step (b) further includes forming a strengthening layer outside the at least one conductive coating. More specifically, the carbon nanotube structure 214 with the at least one conductive coating can be immersed in a container 220 with a liquid polymer. Thus, the entire surface and spaces between the carbon nanotube structure 214 can be soaked with the liquid polymer. After concentration (i.e., being cured), the strengthening layer can be formed on the outside of the coated carbon nanotubes.

In step (c), when the carbon nanotube structure 214 is the carbon nanotube film having a relatively small width (e.g., about 0.5 nanometers to 100 microns), the carbon nanotube structure 214 with at least one conductive coating thereon can be seen as a carbon nanotube wire-like structure 222 without additional mechanical or chemical treatment.

When the carbon nanotube structure 214 is the carbon nanotube film having a relatively large width (e.g., about 100 microns to above 10 centimeters). The carbon nanotube wire-like structure 222 can be made by a mechanical treatment (e.g., a conventional spinning or twisting process). The mechanical treatment to the carbon nanotube wire structure 222 can be executed by twisting or cutting the carbon nanotube structure 214 with the at least one conductive coating along an aligned direction of the carbon nanotubes in the carbon nanotube structure 214.

There are many ways to twist the carbon nanotube structure 214. One manner includes the following steps of: adhering one end of the carbon nanotube structure to a rotating motor; and twisting the carbon nanotube structure by the rotating motor to form the carbon nanotube wire-like structure 222. A second manner includes the following steps of: supplying a spinning axis; contacting the spinning axis to one end of the carbon nanotube structure 214; and twisting the carbon nanotube structure 214 by the spinning axis.

A plurality of carbon nanotube wire-like structures 222 can be stacked or twisted to form one carbon nanotube wire-like structure with a larger diameter. A plurality of coated carbon nanotube structures 214 can be arranged parallel to each other and then twisted to form the carbon nanotube wire-like structure with the large diameter. Also two or more coated carbon nanotube structures 214 can be stacked and then twisted to form the carbon nanotube wire-like structure with the large diameter. In one embodiment, about 500 layers of carbon nanotube films are stacked with each other and twisted to form a carbon nanotube wire-like structure 222 whose diameter can reach 3 millimeters. It is to be understood that the diameter can be even larger (e.g., 20 millimeters to 30 millimeters) and the coaxial cable can be used in electrical power transmission.

Figure 8:
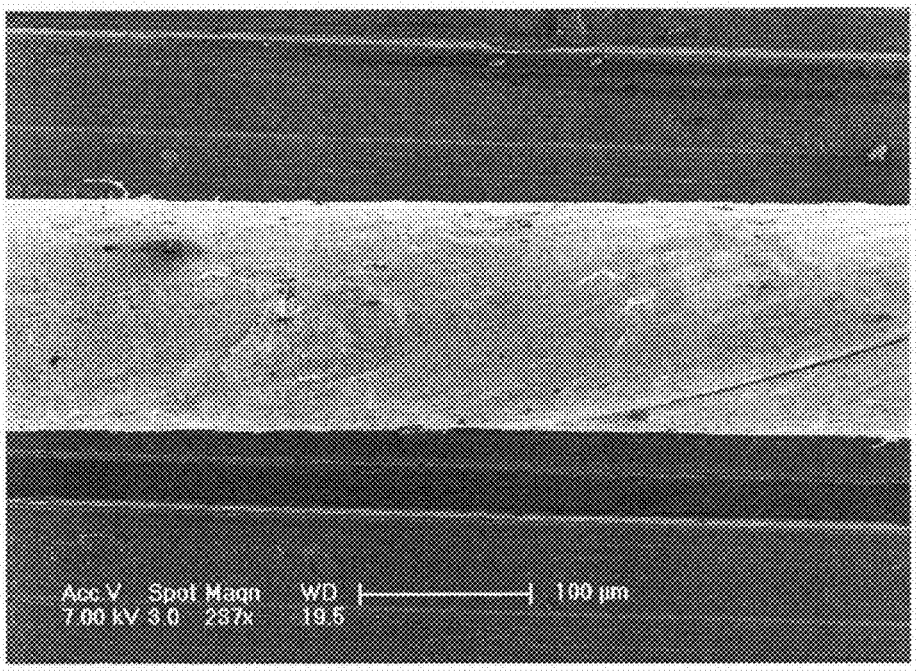
FIG. 8 shows a Scanning Electron Microscope (SEM) image of an individually coated twisted carbon nanotube wire-like structure, in accordance with the first embodiment.
Figure 9:
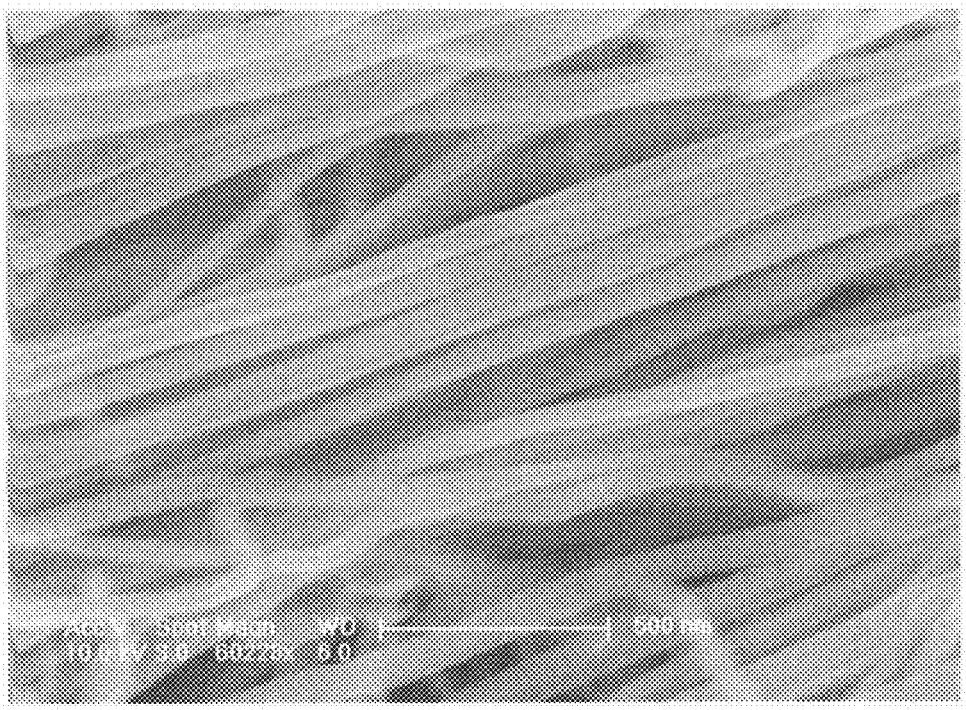
FIG. 9 shows a Scanning Electron Microscope (SEM) image of the carbon nanotubes with at least one layer of conductive coating individually coated thereon in the twisted carbon nanotube wire-like structure of FIG. 8.

An SEM image of a carbon nanotube wire-like structure 222 can be seen in FIGS. 8 and 9. The carbon nanotube wire-like structure 222 includes a plurality of carbon nanotubes with at least one conductive coating and aligned around the axis of carbon nanotube wire-like structure 222 like a helix.

Optionally, the steps of forming the carbon nanotube structure 214, the at least one conductive coating, and the strengthening layer can be processed in the vacuum container 210 to achieve a continuous production of the carbon nanotube wire-like structure 222. The acquired carbon nanotube wire-like structure 222 can be further collected by a first roller 224. The carbon nanotube wire-like structure 222 is coiled onto the first roller 224.

Step (d) can be executed by a first squeezing device 230. The melting polymer is coated on an outer surface of the carbon nanotube wire-like structure 222 by the first squeezing device 230. After concentration (e.g., being cured), the insulating layer 120 is formed. In the first embodiment, the polymer is polyethylene foam component. When the coaxial cable 10 includes two or more insulating layers 120, step (d) can be repeated.

In step (e), a layer of shielding material can be formed by woven wires or by winding films around the at least one layer of insulating material 120. The shielding films 232 can be provided by a second roller 234. The wires can be metal wires or carbon nanotube wires. The films can be metal films, carbon nanotube films or composite films having carbon nanotubes. The wires can be winded on the at least one layer of insulating material 120 by a rack 236. The carbon nanotubes in the carbon nanotube film cap be orderly and/or disorderly.

Step (f) can be executed by a second squeezing device 240. The sheathing material is coated on an outer surface of the shielding layer 130 by the second squeezing device 240 to form the sheathing layer 140. After concentration (e.g., being cured), the sheathing layer 140 is formed. In the first embodiment, the sheathing material is nano-clay-polymer composite material. The acquired coaxial cable 10 can be further collected by a third roller 260 by coiling the coaxial cable 10 onto a third roller 260.

The conductivity of the carbon nanotube wire-like structure 222 is better than the conductivity of the carbon nanotube structure 214 without conductive coating on each carbon nanotube. The resistivity of the carbon nanotube wire-like structure 222 can be ranged from about $10\times10^{-8}$ Ω·m to about $500\times10^{-8}$ Ω·m. In the present embodiment, the carbon nanotube wire-like structure 222 has a diameter of about 120 microns, and a resistivity of about $360\times10^{-8}$ Ω·m. The resistivity of the carbon nanotube structure 214 without conductive coating is about $1\times10^{-5}$ Ω·m~$2\times10^{-5}$ Ω·m.

Figure 10:
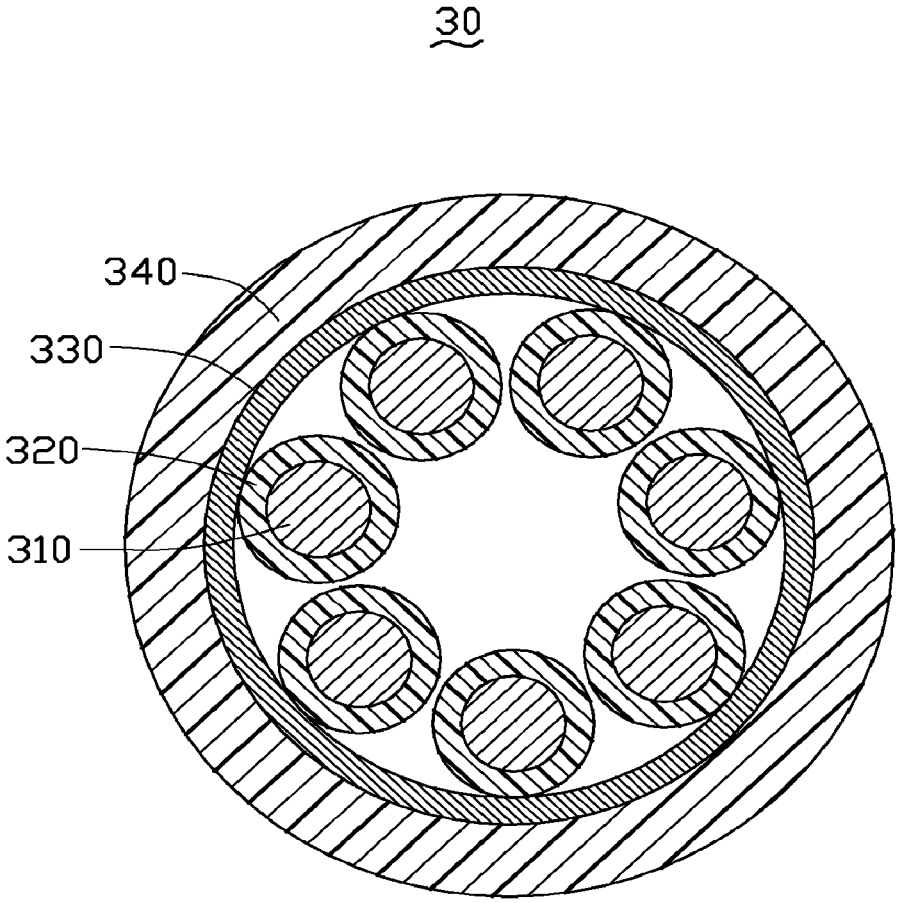
FIG. 10 shows a schematic section view of a coaxial cable, in accordance with a second embodiment.

Referring to FIG. 10, a coaxial cable 30 according to a second embodiment includes a plurality of cores 310, a plurality of insulating layers 320, a shielding layer 330, and a sheathing layer 340. Each insulating layer 320 wraps each core 310. The shielding layer 330 wraps the plurality of insulating layers 320 therein. The sheathing layer 340 wraps the shielding layer 330. Between the shielding layer 330 and the insulating layer 320, insulating material is filled. The method for making the coaxial cable 30 of the second embodiment is similar to that of the coaxial cable 10 of the first embodiment.

Figure 11:
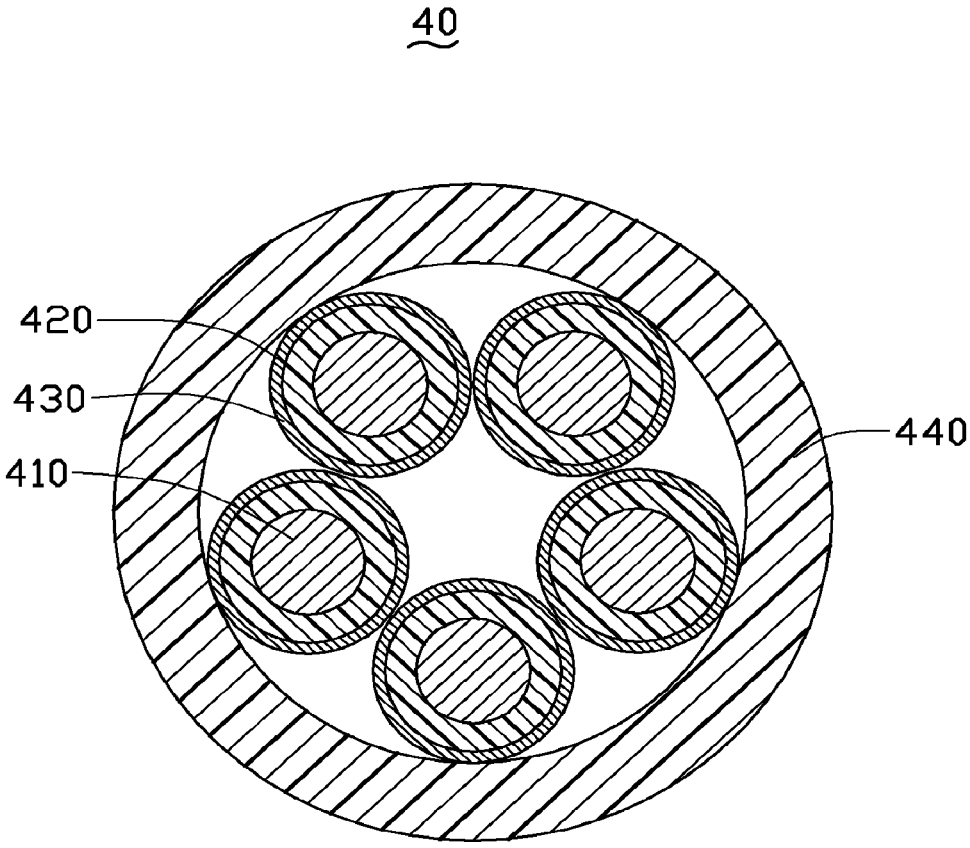
FIG. 11 shows a schematic section view of a coaxial cable, in accordance with a third embodiment.

Referring to FIG. 11, a coaxial cable 40 according to a third embodiment includes a plurality of cores 410, a plurality of insulating layer 420, a plurality of shielding layer 430, and a sheathing layer 440. The insulating layer 430 wraps each of the plurality of cores 410. The shielding layer 430 wraps each of the insulating layer 420. The sheathing layer 440 wraps all the shielding layers 430. The method for making the coaxial cable 40 of the third embodiment is similar to that of the coaxial cable 10 of the first embodiment.

In this embodiment, each shielding layer 430 can shield each core 410 respectively. The coaxial cable 40 is configured to avoid interference coming from outer factors, and avoid interference between the plurality of cores 410.

The coaxial cable 10, 30, 40 provided in the embodiments has the following superior properties. Firstly, the coaxial cable 10, 30, 40 includes a plurality of oriented carbon nanotubes joined end-to-end by van der Waals attractive force, whereby the coaxial cable has high strength and toughness. Secondly, the outer surface of each carbon nanotube is covered by at least one conductive coating, such that the core 110, 210, 410 made of carbon nanotubes has high conductivity. Thirdly, the method for making the core 110, 210, 410 of the coaxial cable 10, 30, 40 can be performed by drawing a carbon nanotube structure from a carbon nanotube array and forming at least one conductive coating on the carbon nanotube structure. The method is simple and relatively inexpensive. Additionally, the coaxial cable 10, 30, 40 can be formed continuously and, thus, a mass production thereof can be achieved. Fourthly, since the carbon nanotubes have a small diameter, and the cable includes a plurality of carbon nanotubes and at least one conductive coating thereon, thus the coaxial cable 10, 30, 40 has a smaller width than a metal wire formed by a conventional wire-drawing method and can be used in ultra-fine cables. Since the carbon nanotubes are hollow, and a thickness of the at least one layer of the conductive material is just several nanometers, thus a skin effect is less likely to occur in the coaxial cable 10, 30, 40, and signals will not decay as much during transmission. Due to the diameters of the core and the carbon nanotube-wire like structure can be very large, the coaxial cable can be used in electrical power transmission. The carbon nanotube has lower weight than metals, thus, the weight of the coaxial cable is decreased.

It is to be understood that the above-described embodiments are intended to illustrate rather than limit the invention. Variations may be made to the embodiments without departing from the spirit of the invention as claimed. The above-described embodiments illustrate the scope of the invention but do not restrict the scope of the invention.

It is also to be understood that the above description and the claims drawn to a method may include some indication in reference to certain steps. However, the indication used is only to be viewed for identification purposes and not as a suggestion as to an order for the steps.

What is claimed is:

1. A coaxial cable comprising:

a core comprising a plurality of carbon nanotubes having at least one conductive coating disposed about the carbon nanotubes, the carbon nanotubes being orderly arranged;

an insulating layer about the core;

a shielding layer about the insulating layer; and a sheathing layer about the shielding layer.

2. The coaxial cable as claimed in claim 1, wherein the carbon nanotubes are parallel to an axial direction of the core.

3. The coaxial cable as claimed in claim 1, wherein the conductive coating is in contact with the surface of the carbon nanotubes.

4. The coaxial cable as claimed in claim 3, wherein the carbon nanotubes are organized in the form of at least one carbon nanotube wire.

5. The coaxial cable as claimed in claim 4, wherein the carbon nanotubes in the carbon nanotube wire are joined end-to-end by van der Waals attractive force therebetween.

6. The coaxial cable as claimed in claim 4, wherein the carbon nanotubes in the carbon nanotube wire are aligned along the axial direction of the carbon nanotube wire.

7. The coaxial cable as claimed in claim 4, wherein the carbon nanotubes in the carbon nanotube wire are helically aligned around the axial direction of the carbon nanotube wire.

8. The coaxial cable as claimed in claim 4, wherein a diameter of the carbon nanotube wire is in the range from about 4.5 nanometers to about 1 millimeter.

9. The coaxial cable as claimed in claim 4, wherein the core comprises a plurality of the carbon nanotube wires braided together.

10. The coaxial cable as claimed in claim 3, wherein the conductive coating comprises a conductive layer.

11. The coaxial cable as claimed in claim 10, wherein material of the conductive layer comprises of a material selected from the group consisting of copper, silver, gold and alloys thereof, a thickness of the conductive layer is in the range from about 1 to about 20 nanometers.

12. The coaxial cable as claimed in claim 10, wherein the conductive coating further comprises a wetting layer located between the carbon nanotube and the conductive layer, the material of the wetting layer comprises of a material selected from the group consisting of iron, cobalt, nickel, palladium, titanium, and alloys thereof.

13. The coaxial cable as claimed in claim 12, wherein the conductive coating further comprises a transition layer between the wetting layer and the conductive layer, the material of the transition layer comprises of a material selected from the group consisting of copper, silver and alloys thereof.

14. The coaxial cable as claimed in claim 10, wherein the conductive coating further comprises an anti-oxidation layer about the conductive layer, the material of the anti-oxidation layer comprises of a material selected from the group consisting gold, platinum and alloys thereof.

15. The coaxial cable as claimed in claim 10, wherein the core further comprises a strengthening layer outside the conductive layer, the material of the strengthening layer comprises of a material selected from the group consisting of polyvinyl acetate, polyvinyl chloride, polyethylene, paraphenylene benzobisoxazole, and combinations thereof.

16. The coaxial cable as claimed in claim 1, wherein the insulating layer is located about the core, the shielding layer is located about the insulating layer, and the sheathing layer is located about the shielding layer.

17. The coaxial cable as claimed in claim 1, wherein the coaxial cable comprises a plurality of cores and a plurality of insulating layers, wherein each insulating layer located about one core, and the shielding layer and the sheathing layer located about the plurality of cores.

18. The coaxial cable as claimed in claim 1, wherein the coaxial cable comprises a plurality of cores, a plurality of insulating layers, a plurality of shielding layers, and the sheathing layer, each insulating layer located about one core, each shielding layer is located about one insulating layer, and the sheathing layer is located about the plurality of cores.

19. The coaxial cable as claimed in claim 1, wherein material of the shielding layer is selected from the group consisting of metals, carbon nanotubes, composite having carbon nanotubes, composite having metals, and combinations thereof.

20. The coaxial cable as claimed in claim 19, wherein the shielding layer is selected from a group consisting of at least one woven wire, at least one winded film.

21. The coaxial cable as claimed in claim 20, wherein the shielding layer is selected from a group consisting of at least one metal wire, at least one metal film, at least one carbon nanotube wire, at least one carbon nanotube film, at least one composite carbon nanotube film, at least one composite carbon nanotube wire, and combinations thereof.

22. The coaxial cable as claimed in claim 19, wherein the shielding layer comprises of carbon nanotubes having a conductive coating disposed on the outside surfaces.

23. A coaxial cable comprising:

a core comprising a plurality of carbon nanotubes, each of the carbon nanotubes being covered by at least one conductive coating;

an insulating layer surrounding the core;

a shielding layer surrounding the insulating layer; and a sheathing layer surrounding the shielding layer.

* * * * *